US005123611A

United States Patent [19]

Morgand

[11] Patent Number: 5,123,611

[45] Date of Patent: Jun. 23, 1992

[54] SYSTEM FOR STEERING A MISSILE BY MEANS OF LATERAL GAS JETS

[75] Inventor: Jean-Pierre Morgand, Paris, France

[73] Assignee: Aerospatiale Societe Nationale Industrielle, Paris, France

[21] Appl. No.: 665,899

[22] Filed: Mar. 7, 1991

[30] Foreign Application Priority Data

Mar. 14, 1990 [FR] France ..... 90 03253

[51] Int. Cl.[5] ..... F42B 10/66

[52] U.S. Cl. ..... 244/3.22

[58] Field of Search ..... 244/3.22; 239/265.11, 239/265.19, 265.25, 265.27, 265.29

[56] References Cited

U.S. PATENT DOCUMENTS

| | | | |
|---|---|---|---|
| 3,136,250 | 6/1964 | Humphrey | 244/3.22 |
| 3,721,402 | 3/1973 | Holland | 244/3.22 |
| 4,085,909 | 4/1978 | East et al. | 244/3.22 |
| 4,441,670 | 4/1984 | Crepin | 244/3.22 |
| 4,531,693 | 7/1985 | Raynaud et al. | 244/3.22 |
| 4,632,336 | 12/1986 | Crepin | 244/3.22 |

FOREIGN PATENT DOCUMENTS

| | | |
|---|---|---|
| 0064433 | 11/1982 | European Pat. Off. . |
| 2743371 | 4/1978 | Fed. Rep. of Germany . |
| 2620812 | 3/1989 | France . |
| 2622066 | 4/1989 | France . |

*Primary Examiner*—Charles T. Jordan

*Attorney, Agent, or Firm*—Marshall, O'Toole, Gerstein, Murray & Bicknell

[57] ABSTRACT

A system is disclosed for steering a missile by means of gas jets, comprising a gas generator connectable to at least a pair of lateral nozzles via rotary valving means, movable under the action of drive means and controlling the passage of the gases through said nozzles wherein with each nozzle is associated an individual rotary valving member;

each valving member is controlled in rotation by the piston of a jack, one chamber of which receives a part of the gas generated by said gas generator, the position of said piston being controlled by controlling the flowrate of said gas through said chamber;

the chambers of said jacks, opposite those receiving said gas flows, are connected together by a coupling circuit containing a pressurized incompressible fluid; and the volume of said pressurized incompressible fluid is chosen so that one of the valving members may be in the completely open position of the associated nozzle, whereas all the other valving members completely close the nozzles which correspond thereto.

12 Claims, 6 Drawing Sheets

2/6

III III'
12
3
8
13
4
10
8a
22a
23
11
2a
19
15
14
ℓ.ℓ
18a
22b
L
18
22
3a
III

FIG. 6
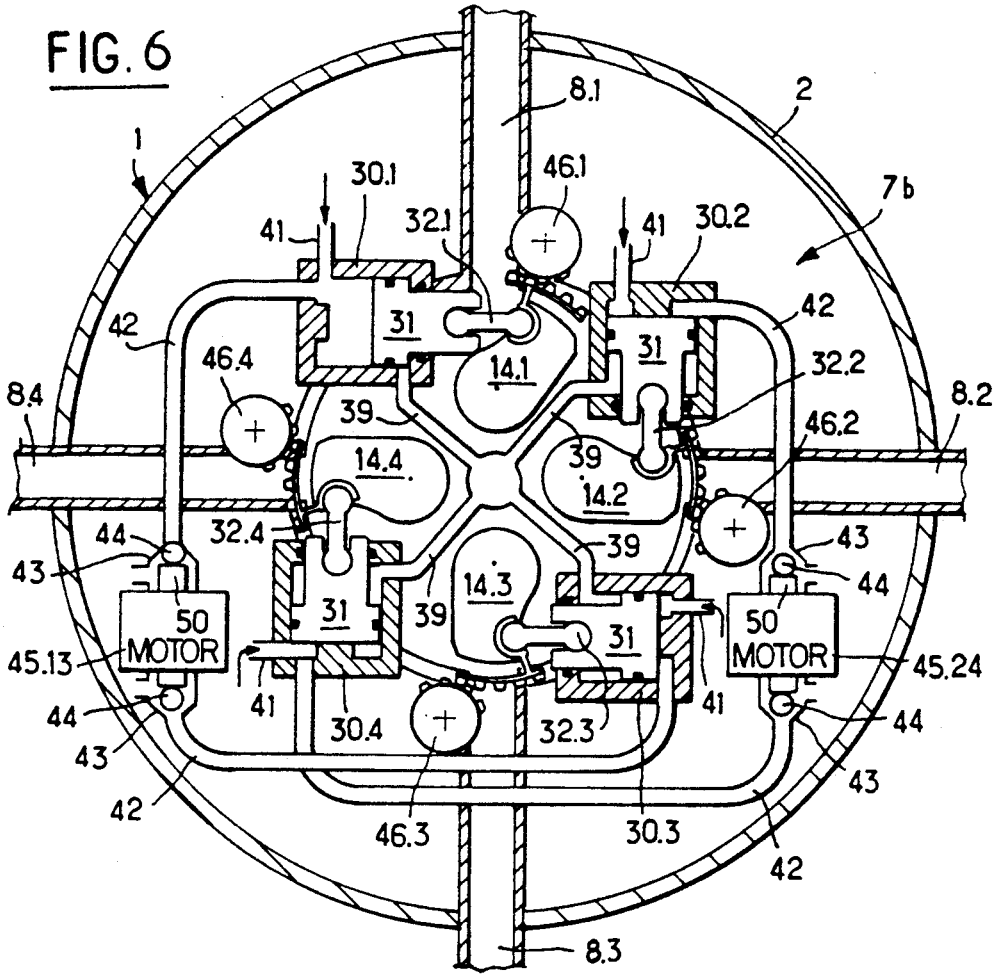
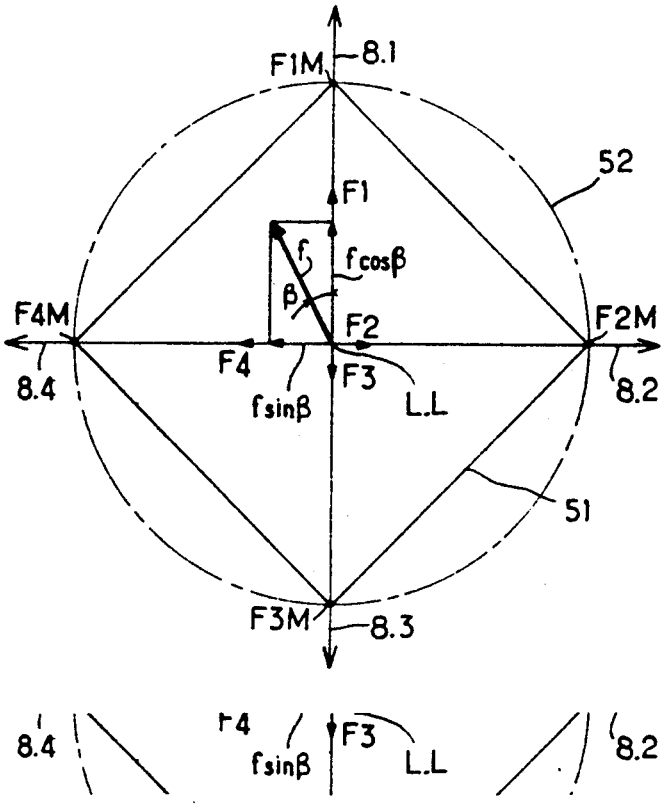
FIG. 7

FIG. 9
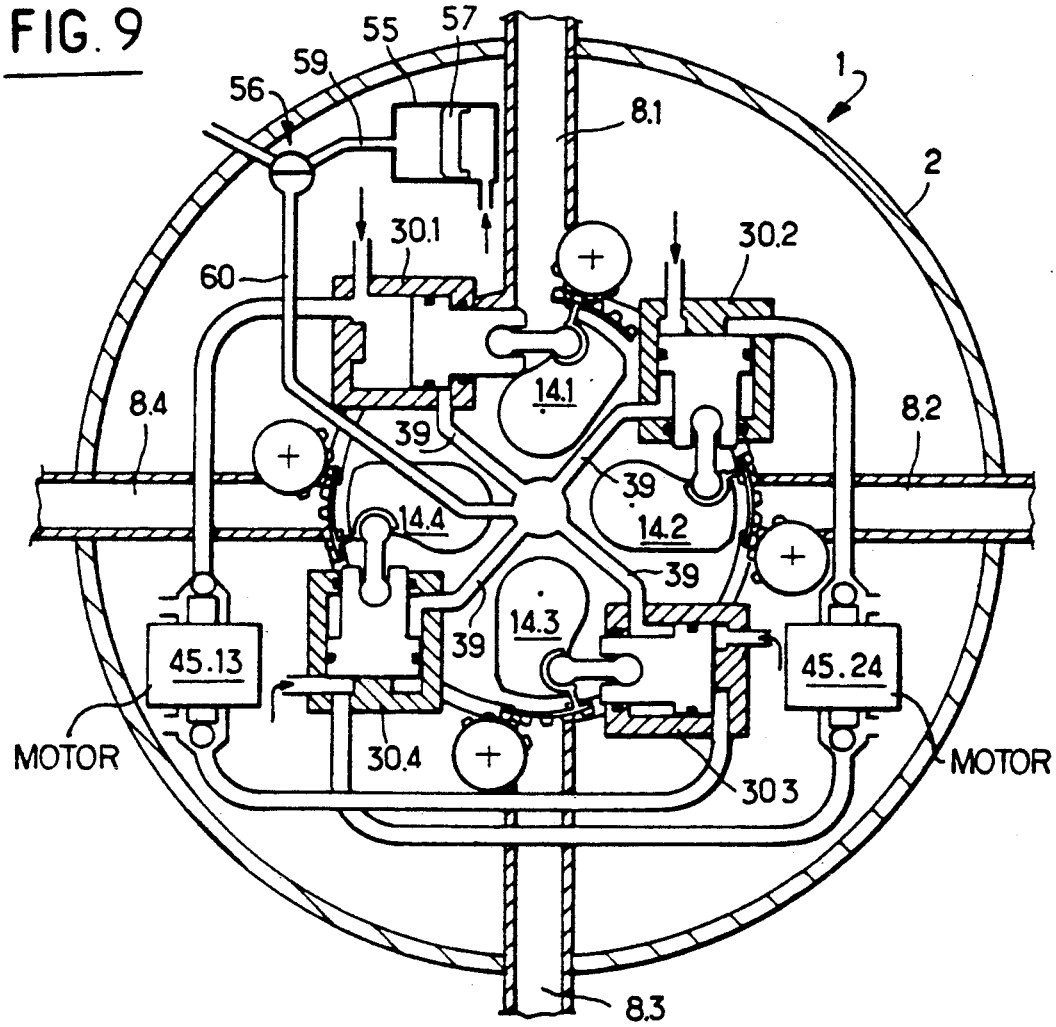
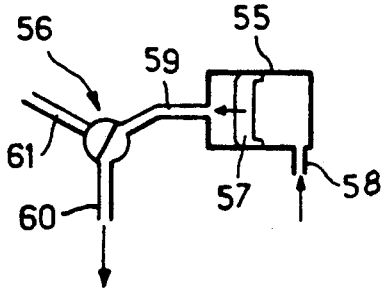
FIG. 10a
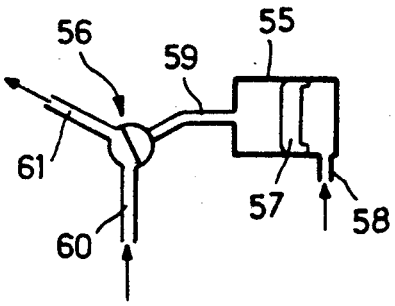
FIG. 10b

SYSTEM FOR STEERING A MISSILE BY MEANS OF LATERAL GAS JETS

BACKGROUND OF THE INVENTION

1. Field of the Invention

The invention relates to a system for steering a missile by means of lateral gas jets and a missile comprising such a system.

When a missile is to be steered with high load factors, lateral nozzles are provided on board this missile which are fed with gas either from a gas generator of the main thrustor, or from a gas generator specially provided for this purpose. Thus, lateral gas jets are provided generating transverse propulsive forces capable of rapidly and appreciably changing the direction of the trajectory of the missile. The action lines of such transverse forces can be caused to pass through the center of gravity of the missile, or at least in the vicinity thereof and then the missile is said to be force steered, the response time to the control being particularly fast. However, this is not obligatory and the lines of action of said transverse forces may pass through points of the axis of the missile different from the center of gravity. Said transverse forces then create, similarly to conventional aerodynamic steering surfaces, moments for controlling the missile in attitude with respect to the center of gravity.

2. Description of the Prior Art

From the patent U.S. Pat. No. 4,531,693 and the French patent FR-A-2 620,812, a system is known for steering a missile by means of lateral gas jets, comprising a gas generator able to be connected to at least a pair of lateral nozzles via rotary valving members, moving under the action of the drive means and controlling the passage of the gases through said nozzles.

In the system of the American patent U.S. Pat. No. 4,531,693, with each of said nozzles there is associated an individual rotary valving member, itself being controlled individually by an oscillator. With this structure, each rotary valving member may have low inertia so that the response time of the valving means and so of the steering may be very small.

Furthermore, because there is an oscillator for each of said valving members, it is easy to control the whole of said oscillators so that, at all times, the position of each valving member (completely open, total closure or partial closure) corresponds exactly to the steering phase and/or to the state of said gas generator. On the other hand, because said rotary valving members are controlled by oscillators, a controlled position of a valving member with respect to the corresponding nozzle is not reached directly, but by a train of oscillations. In addition, these oscillations may induce parasite oscillations in the missile, complicating steering thereof.

On the other hand, in the system of the French patent FR-A-2 620 812, to provide the necessary control coupling between said nozzles, a rotary valving member is provided common to the two nozzles, this valving member being controlled by the piston of a jack whose two chambers receive a part of the gas generated by said generator the position of the piston of said jack, and so that of said valving member, being controlled by controlling the flowrate of said gas in one of said chambers of the jack. With such a control, the rotary valving member may reach its position directly, without oscillations. However, in this case, the rotary valving member is necessarily cumbersome, so that its inertia and its response time ar high.

SUMMARY OF THE INVENTION

The object of the present invention is to provide a system of the above mentioned type having both valving means with low inertia and valving control without oscillations.

For this, according to the invention, the system for steering a missile by means of gas jets, comprising a gas generator connectable to at least a pair of lateral nozzles via rotary valving members, movable under the action of drive means and controlling the passage of the gases through said nozzles is remarkable in that:

- with each nozzle is associated an individual rotary valving member;
- each valving member is controlled in rotation by the piston of a jack, one chamber of which receives a part of the gas generated by said gas generator, the position of said piston being controlled by controlling the flowrate of said gas through said chamber;
- the chambers of said jacks, opposite those receiving said gas flows, are connected together by a coupling circuit containing a pressurized incompressible fluid; and
- the volume of said pressurized incompressible fluid is chosen so that one of the valving members may be in the completely open position of the associated nozzle, whereas all the other valving members completely close the nozzles which correspond thereto.

Thus, each valving member may have low inertia, and the position of each controlled valving member is determined, without oscillations, by the corresponding controlled jack, the non controlled jacks taking up a given position by distribution of said pressurized incompressible fluid.

In order to reduce the inertia of the valving means as much as possible, each nozzle has an oblong section, at least in the vicinity of its neck cooperating with a valving member. Thus, each valving member may be formed by a shaft fast with a projecting radial plate whose longitudinal end face cooperates with the neck of the corresponding nozzle.

Advantageously, in order to reduce the torque exerted by the gases on the valving means, tending to oppose opening thereof, the lateral face of the radial plate, opposite the neck of the nozzle in the open position of said valving means, is concave and curved.

Preferably, said valving members are mounted in a rigid block integral with the structure of said missile.

When said nozzles are formed in wings of said missile integral with the skin thereof, it is advantageous for the feet of said nozzles to be fitted with a sliding fit in said rigid block. Thus, the deformations of said nozzles are decoupled from the rest of the missile.

Control of the gas flow through a jack is preferably obtained by means of a linear motor moving a ball, in a bell-mouth portion provided in the circuit of said gas flow.

When the system comprises two pairs of lateral nozzles, with the two nozzles of a pair diametrically opposite and the nozzles of a pair being disposed in a radial plane perpendicular to the radial plane containing the nozzles of the other pair, at most, a valving member of each pair of nozzles is controlled simultaneously with a valving member of the other pair of nozzles.

In this case, it is preferable for the two valving members of a pair of nozzles to be controlled by the same motor.

In this case, computing means are provided on board the missile for solving the system of equations:

$$f \cos \beta = F1 - F3 \quad (1)$$

$$f \sin \beta = F4 - F2 \quad (2)$$

$$F1 + F2 + F3 + F4 = P \quad (3)$$

and $$F2 = F3 \text{ or } F1 = F4 \quad (4)$$

in which f is the intensity of a desired radial thrust, $\beta$ is the angle formed by said desired radial thrust with the radial thrust F1 from one of said nozzles, and F2, F3 and F4 are the radial thrusts from the other three nozzles.

A pressurized incompressible fluid reserve may be provided for connection to said coupling circuit. Such a reserve may be connected to said coupling circuit by a valving member, capable of connecting said coupling circuit to exhaust.

BRIEF DESCRIPTION OF THE DRAWINGS

The figures of the accompanying drawings will better show how the invention may be put into practice. In these figures, identical references designate similar elements.

FIG. 6 illustrates schematically one application of the actuating means of FIGS. 4 and 5 to the control of four valving members, diametrically opposite two by two;

FIG. 7 is a diagram illustrating the operation of the system of FIG. 6;

FIG. 9 shows a variant of the control system of FIG. 6; and

FIGS. 10*a* and 10*b* are diagrams illustrating the operation of the device of FIG. 9.

DESCRIPTION OF THE PREFERRED EMBODIMENT

Figure 1:
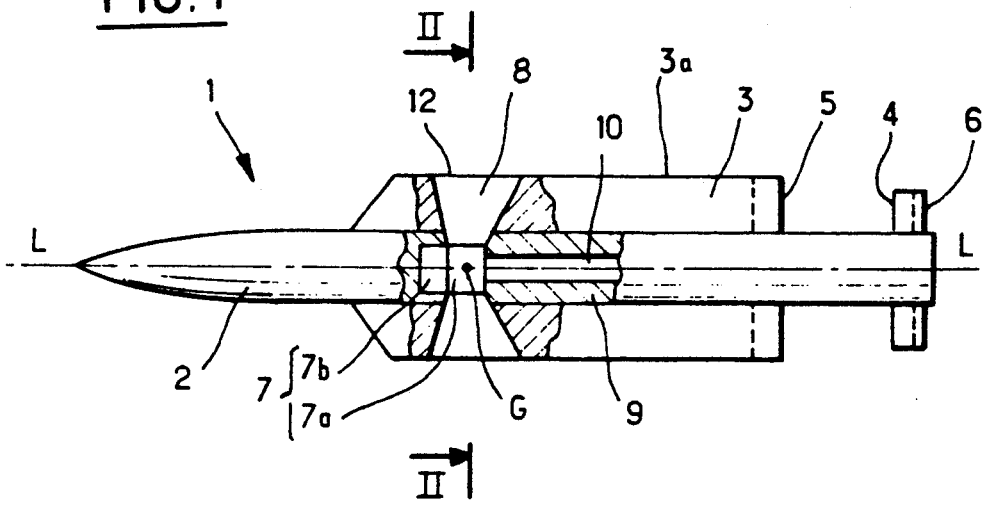
FIG. 1 is a schematic view of one embodiment of the missile according to the invention, with parts cut away.
Figure 2:
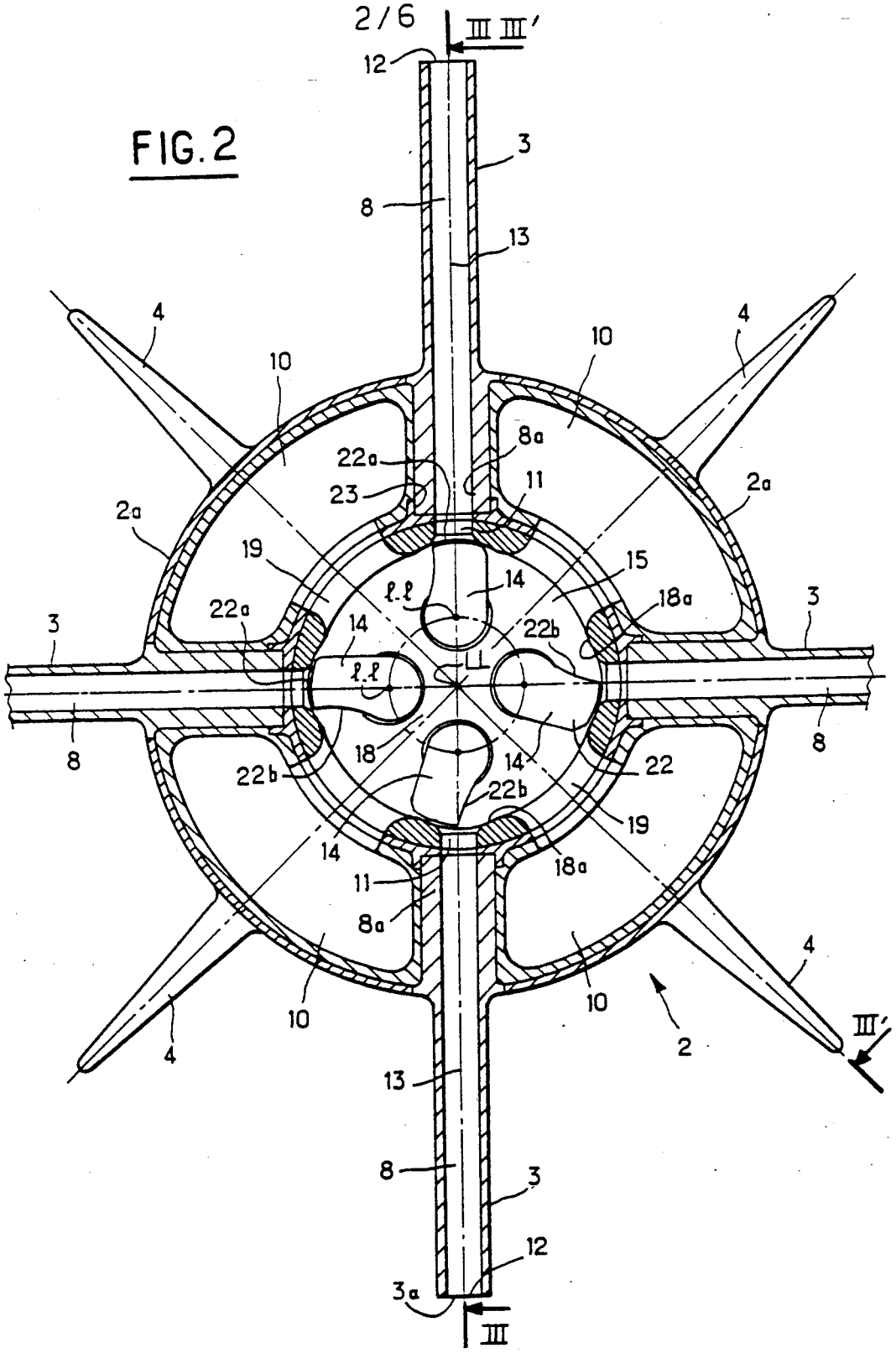
FIG. 2 is a partial cross section, on a larger scale, of the missile according to the invention through line II—II of FIG. 1.
Figure 3:
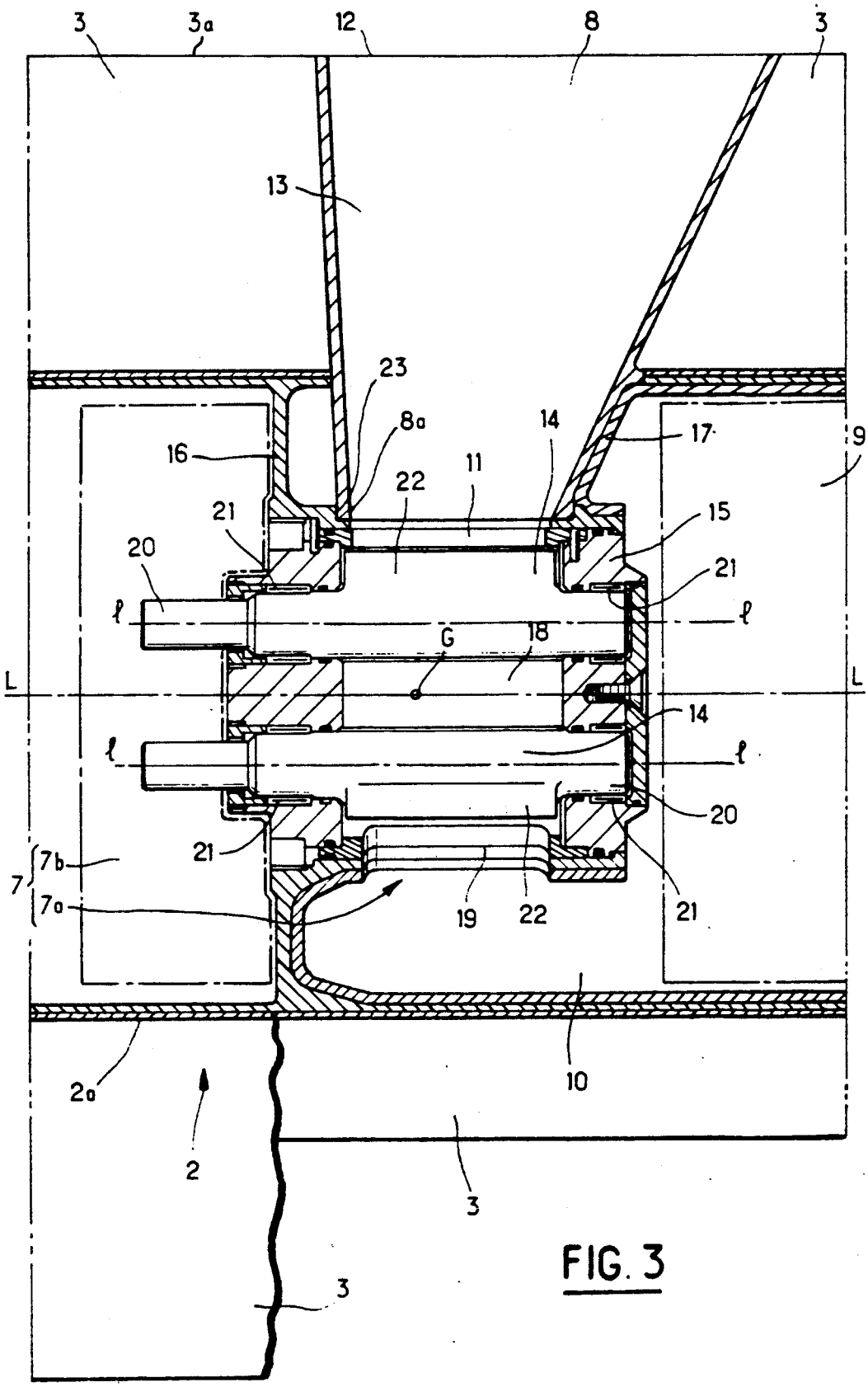
FIG. 3 is a partial longitudinal section of the missile according to the invention, the left and right-hand parts of this figure corresponding respectively to lines III—III and III'—III' of FIG. 2.

The embodiment of the missile 1 according to the invention, shown schematically in FIGS. 1 to 3, comprises an elongate body 2 with axis L—L having wings 3 and tail fins 4. Wings 3 and tail fins 4 are provided with control surfaces 5 and 6, respectively. Wings 3 are four in number and they are diametrically opposite in twos, the planes of two consecutive wings being orthogonal to each other and passing through the axis L—L. Similarly, the tail fins 4 are four in number and they are diametrically opposite in twos, the planes of two consecutive tail fins being orthogonal to each other and passing through axis L—L. In addition, the tail fins 4 are in the bisector planes of wings 3.

In the vicinity of the center of gravity G of missile 1, there is provided in body 2 a force steering device 7 controlling four nozzles 8, diametrically opposite in twos, and disposed in wings 3. Nozzles 8 are placed in the vicinity of the combustion chamber of a gas generator 9, for example with solid propergol and are connected to said gas generator 9 by ducts 10.

Nozzles 8 may be connected to ducts 10 through an inlet orifice or neck 11 and they open to the outside through an outlet orifice 12, of a larger cross section than the inlet orifice 11, said orifices 11 and 12 being connected together by a divergent portion 13. The outlet orifices 12 are situated at the level of the longitudinal edge 3*a* gs 3 so that the gas jets passing through nozzles 8 are deviated from the body 2 of the missile and only interfere very little with the aerodynamic flow about the skin 2*a* d body 2.

As will be explained in greater detail hereafter, each of nozzles 8 is equipped, at the level of its inlet orifice 11, with a valving member or rotary valve 14 (not shown in FIG. 1) for closing or on the contrary opening the corresponding nozzle 8 at least partially.

In flight, without a high load factor, the action of the force steering device 7 is not absolutely necessary, for then missile 1 may be steered conventionally with its aerodynamic control surfaces 5 and 6. Consequently, if the gas generator 9 is of the controlled operation type, it may be stopped. If the gas generator 9 is of the continuous operation type, the valving members 14 of two opposite nozzles are controlled so that the gas jets which they emit exert on the missile forces whose resultant is zero; thus, in this case, the valving members 14 of two opposite nozzles are constantly partially open to let the gases produced by the gas generator 9 escape.

On the other hand, in flight with a high load factor, to cause a sudden change of orientation of the trajectory of the missile, it is necessary to cause at least one of nozzles 8 to function fully, so as to obtain this sudden change of direction. In this case, the valving means 14 of the nozzle(s) controlled to operate is largely retracted so that the lateral and transverse gas jet(s) emitted are considerable and force the missile 1 to suddenly change direction, whereas the valving members 14 of the nozzles which are not operated close the corresponding nozzles to a great extent, if not completely.

It will be noted that, since they are incorporated in the wings 3, nozzles 8 have the form of a flattened funnel. The outlet orifice 12 is of oblong shape, the large dimension of its cross section being parallel to the longitudinal axis L—L of missile 1, whereas the small dimension of this cross section is transversal to said axis L—L. This small transverse dimension is advantageously constant and the ends of the outlet orifice 12 may be rounded.

The inlet orifice or neck 11, situated on the inner side of missile 1, also has an oblong shape, of constant width and with rounded ends. The cross section of said neck 11 is similar to that of the outlet orifice 12, but smaller than that of this latter. The divergent portion 13 is connected to the two orifices 11 and 12 by an adjusted surface. The cross section ratio required for sufficiently expanding the combustion gases from the gas generator 9 is largely obtained by determining the respective lengths of orifices 11 and 12.

With the oblong structure of nozzles 8, the lateral steering jets are in the form of sheets having a low front dimension for the aerodynamic flow. Consequently, the interaction between said lateral steering jets and said aerodynamic flow, already lessened by moving the outlet orifices 12 away from skin 2*a* of body 2 is, if not completely suppressed, at least further reduced so that the aerodynamic elements 3, 4, 5 and 6 may continue to fulfil their function while cooperating with the aerodynamic flow, even when the lateral steering jets are used at maximum power.

As is particularly clear from FIG. 3, the force steering device 7 is formed of two parts 7*a* and 7*b*, namely a part 7*a* in which the valving members 14 are fitted and a part 7*b* for controlling said valving members.

Part 7*a* of the force steering device 7 comprises a central rigid block 15, coaxial with axis L—L and forming a case inside which the mobile valving members 14 are disposed. The rigid block 15 is connected rigidly to the internal structure of body 2 of missile 1 by end webs 16, 17. This rigid block 15 is hollow and comprises an internal recess 18 in communication with ducts 10 through peripheral openings 19. Furthermore, the rigid block 15 has other peripheral openings forming the nozzle necks 11 and in communication with the internal recess 18, under the dependence of the valving members 14.

The rotary valving members 14 each comprise a shaft 20 with axis 1—1, parallel to axis L—L of the missile, mounted with respect to the rigid block 15 on low friction bearings 21, for example ball bearings. Each valving member 14 comprises a radial plate 22, fast with the corresponding shaft 20 and projecting outwardly with respect thereto. The external longitudinal face 22*a* of the radial plates 22 cooperates with the corresponding nozzle neck/either for closing it (see the position of valving members 14 at the top left of FIG. 2) or for freeing said nozzle neck 11/partially (see the position of the valving members 14 at the bottom right of FIG. 2).

When the valving members 14 are in this closed position, they isolate the internal recess 18 from nozzles 8 and therefore the latter from ducts 10. On the other hand, when the valving members 14 are in a position freeing necks 11, they place nozzles 8 in communication with ducts 10, through said nozzle necks 11, the internal recess 18 and the peripheral openings 19.

The axes 1—1 of the valving members 14 are disposed respectively in the longitudinal median plane of the nozzles 8.

In order to limit the torque opposing opening of the nozzle necks 11 by the valving members 14, this torque being due to the speeding up of the gases and the depression which results therefrom at the level of said nozzle necks 11, the lateral face 22*b* of plates 22, facing the nozzle necks 11 in the open position of said valving members 14 is concave and curved, profiled so as to form the internal wall 18*a* of the internal recess 18*a* portion converging in the direction of said nozzle necks 11. Thus, the curved lateral faces 22*a* serve as bearing faces for speeding up the gases and transfer the depression generated at a distance from the rotational axes 1—1 of the valving members 14.

The projection of plates 22 with respect to shafts 20 is reduced so that each valving member 14 has very low rotational inertia and a small operating clearance so as to obtain a very short response time with minimum control power. Thus, with such an embodiment of the valving members 14, they have very low inertia, which allows them to have a very reduced response time and limit the torque which opposes opening of the nozzle necks, which avoids the need to provide complex compensation systems.

Of course, the external face 22*a* of the valving members 14 has a minimum clearance with respect to the internal wall 18*a* of block 15, so as to reduce the leaks in the closed position, while allowing expansion caused by the high temperature of the gases, for example when they come from a gas generator 9 of powder type. The choice of the component materials of block 15 and of the valving members 14, as well as the choice of their shape may also contribute to minimizing friction: carbon or molybdenum may for example be used protected or not by thermal protection coatings or sleeves.

Moreover, as is shown in FIGS. 2 and 3, the feet 8*a* of nozzles 8 are fitted into imprints 23, of corresponding shape, provided in the external wall of the rigid block 15, so that the connection between said nozzles 8 and said rigid block 15 is of the sliding fit type. Thus, the nozzles 8, which are fast with the skin 2*a* of body 2, may follow the deformations of the latter. Thus, the deformations between the internal rigid structure of missile 1 and the external skin 2*a* of body 2 are dissociated, which are due partly to the high load factor to which the missile 1 is subjected during force steering manoeuvres, which deformations might generate operating disturbances.

As can be seen in FIG. 3, shafts 20 of the valving members 14 penetrate inside part 7*b* (only shown by a chain-dotted line contour) of the force steering device 7, for controlling said valving members 14. In FIGS. 4 to 8, embodiments of this control part 7*b* have been shown schematically.

Figure 4:
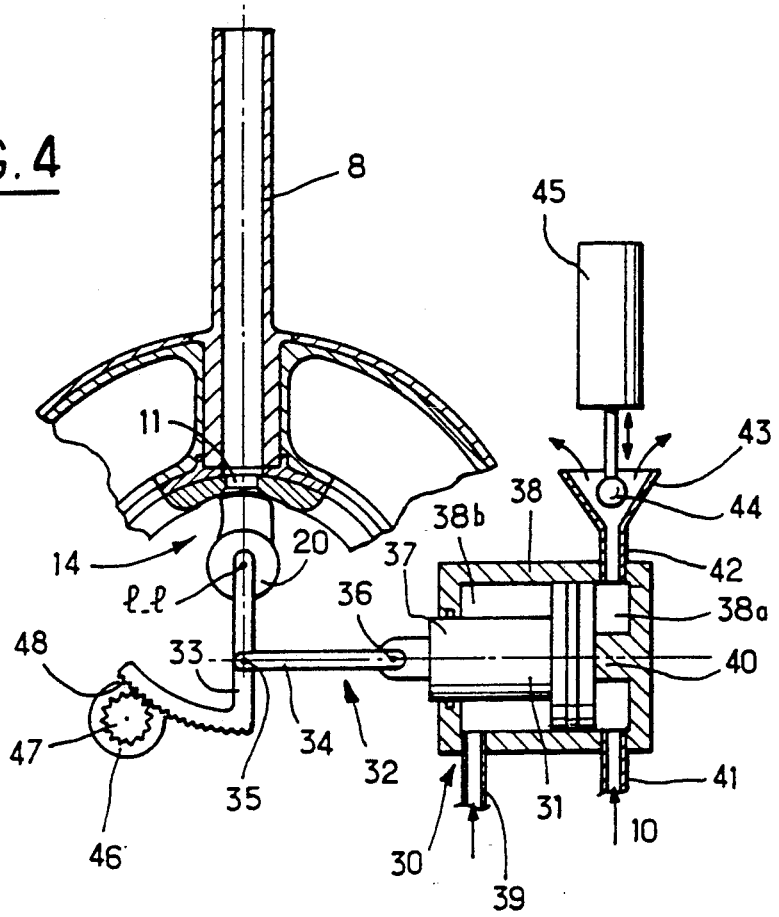
FIGS. 4 and 5 illustrate schematically the means for actuating each valving member.
Figure 5:
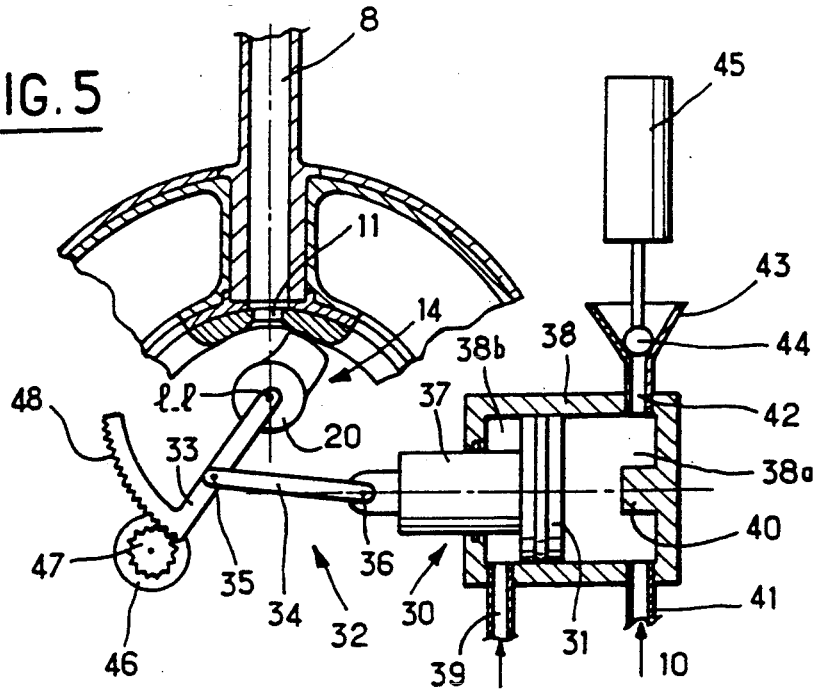

In FIGS. 4 and 5 it can be seen that with each valving member 14 there is associated a jack 30 whose piston 31 is connected to shaft 20 of said member 14 by a mechanical connection 32 comprising, in the example shown, a radial arm 33 interlocked for rotation with said shaft 20 about axis 1—1 and a link 34, respectively articulated at 35 and 36 to said arm 33 and to the rod 37 of said piston 31.

The piston 31 divides the inside of cylinder 38 of jack 30 into two chambers 38*a* and 38*b*. Into chamber 38*b* there extends a duct 39 introducing a pressurized incompressible fluid for pushing piston 31 back towards chamber 38*a*, capable of communicating a position to piston 31 such that the valving member 14 then closes the neck 11 of nozzle 8 (see FIG. 4).

In this case, piston 31 may bear against a stop 40 which is provided in chamber 38*a* and defines the minimum volume that the latter may occupy.

In this minimum volume of chamber 38*a* there open an intake duct 41 of calibrated cross section and an exhaust duct 42 of modulable cross section. The intake duct 41 receives a part, for example about 1%, of the gas flow generated by the gas generator 9 by being for example connected to a duct 10. The exhaust duct 42 is vented, connected for example to the outside of missile 1, so that a slight pressure po prevails in chamber 38*a*. In order to be able to accurately and rapidly modulate the cross section of said exhaust duct 42, the free end thereof is extended by a portion 43 opening out into the form of a funnel and a refractory ball 44 is provided for moving inside said bell-mouth portion 43, in the axis thereof. A motor 45, for example a linear electric motor, is provided for such movement of said ball 44. It can be seen that with such a device ball 44 is automatically centered with respect to the duct 42 in the closed position.

A member 46, for example a rotary potentiometer, is connected to shaft 20, for example via a gear 47 connected to the shaft of said potentiometer and a circular rack 48, centered on axis 1—1 and fast with the radial arm 33, for measuring the rotational position of said valving member 14.

When motor 45 is controlled for retracting ball 44 and completely freeing the exhaust duct 42 (see FIG. 4), i.e. to free between said ball 44 and the facing wall of funnel 43 a flow section at least equal to the cross section of the exhaust duct 42, the gas flow entering through the intake duct 41 escapes freely through said exhaust duct 42, so that this gas flow exerts only the slight pressure po on piston 31, which is pushed back against stop 40 by the action of the pressurized incompressible fluid brought by duct 3*g*. In this position of piston 31, the mechanical connection 32 imposes on the valving member 14 a position in which it completely closes the nozzle neck 11. This closed position is detected by the measuring element 46.

On the other hand, if motor 45 is controlled, from the closed position shown in FIG. 4, to bring the ball 44 closer to the exhaust duct 42, said ball defines with the facing wall of funnel 43 a flow section which gradually decreases. As soon as this flow section becomes less than the cross section of the exhaust duct 42, there is an obstacle to the flow of the gas stream entering through the intake duct 41, so that the gas pressure increases inside chamber 38*a*, beyond the value po. As soon as this pressure is sufficiently great to overcome the action of the pressurized incompressible fluid brought by duct 39, piston 31 moves leftwards in FIG. 4 and the mechanical connection 32 causes the valving member 14 to rotate in the direction for freeing the nozzle neck 11 (clockwise direction in FIG. 4). The gas generated by the gas generator 9 and brought to said neck 11 through ducts 10 and recess 18 may then escape through the nozzle 8. At all times, the corresponding partial open position of the valving member 14 is indicated by the measuring element 46.

If ball 44, under the action of motor 45, continues to draw closer to exhaust duct 42, until said ball 44 comes into contact with the wall of funnel 43 (see FIG. 5), the flow section for the gas stream entering through the intake duct 41 becomes zero and the pressure inside chamber 38*a* takes the value of the pressure of the gases generated by gas generator g. In this situation, piston 31 is pushed sufficiently far back against the action of the pressurized incompressible fluid brought by duct 39 for the mechanical connection 32 to impose on the valving member a position in which it completely frees the neck 11 of nozzle 8.

If now motor 45 is controlled to retract ball 44, a gas flow section is again available between said ball 44 and the facing wall of funnel 43, so that the pressure decreases in chamber 38*a* and the pressurized incompressible fluid brought by duct 39 may push piston 31 back rightward in FIGS. 4 and 5, the valving member 14 rotating in the direction for closing neck 11 (anti-clockwise direction in FIGS. 4 and 5).

The result is that by controlling motor 45 the relative rotation of the valving member 14 may be controlled with respect to the nozzle neck 11, for communicating to this valving member all the desired positions between complete closure of nozzle 8 (FIG. 4) and complete freeing of said nozzle (FIG. 5), the instantaneous position of said valving member being measured by the measuring element 46.

It can then be readily seen that the system of FIGS. 4 and 5, used for each nozzle 8 of missile 1, allows said missile to be force steered. To ensure operation of the double-acting jack, it is preferable for chamber 38*a* to correspond to the large drive section of piston 31 and so that, on chamber 38*b* side, the area of piston 31 is smaller than on chamber 38*a* side. This is obtained through the presence of the piston rod 37.

Thus, the position of the valving member 14 with respect to the nozzle neck 11 results from the balance of the forces between the piston and the corresponding valving member.

In FIG. 6, there has been shown schematically the application of the system of FIGS. 4 and 5 to steering a missile 1 having four nozzles, diametrically opposite in twos and spaced apart at 90° about the axis L—L of said missile. In this figure, the references 8 of said nozzles are subscripted respectively i (with i=1, 2, 3 or 4) progressing in clockwise direction, about axis L—L, the devices associated with a nozzle 8.i themselves bearing the same subscript i. Thus, with each nozzle 8.i are associated a valving member 14.i, a jack 30.i whose piston 31 is connected to the corresponding valving member 14.i by a connection 32.i and a position measuring element 46.i. However, instead of providing one motor 45 per nozzle, in this embodiment a single motor 45 is used for two diametrically opposite nozzles: thus, motor 45.13 controls the valving members 14.1 and 14.3, associated respectively with nozzles 8.1 and 8.3, whereas motor 45.24 controls the valving members 14.2 and 14.4, associated respectively with nozzles 8.2 and 8.4. Each of these motors 45.13 and 45.24 is for example a linear motor of the type described in the patent FR-A-2 622 066, comprising an elongate core 50 movable in translation parallel to itself. A ball 44 is carried by each end of core 50, so as to cooperate with the funnels 43 associated with the exhaust ducts 42 of the corresponding jacks 30.1 and 30.3 or 30.2 and 30.4, so that when a ball 44 draws close to its associated funnel, the other ball 44 moves away from its funnel and vice versa.

Moreover, the ducts 39 of the four jacks 30.1 to 30.4 are connected together, the hydraulic fluid imprisoned in ducts 3*g* and in chambers 38*b* of jacks 30.i being under pressure.

Furthermore, in order to optimize the specific pulse of generator 9, the overall cross section for discharging the gases through the four nozzle 8 - valving member 14 pairs, fixed by the volume of the incompressible hydraulic fluid included between the four jacks 30.1 to 30.4 is chosen equal to the complete opening of the neck 11 of a nozzle 8.

When the two motors 45.13 and 45.24 are in their neutral position (corresponding to the position of motor 45.24 in FIG. 8), their respective balls 44 are moved away from the funnels 43 with which they cooperate and at equal distances therefrom, so that the exhaust cross sections of the four ducts 42 are identical. Thus, under the action of the hydraulic fluid imprisoned between the four chambers 38*b* and ducts 42, the pistons 31 of the four jacks 30.1 to 30.4 occupy identical positions and each of nozzles 8.1 to 8.4 is a quarter open.

If, from this neutral position, one of the motors 45.13 or 45.24 is controlled, the corresponding core moves in the direction imposed by the control while causing a ball 44 to come closer to its associated funnel. Thus, one of the valving members 14 opens more, whereas the other three close and occupy identical partial closed positions, because of the equal distribution of the incompressible hydraulic fluid in chambers 38b and ducts 42. Such control may continue until one of the valving members is completely open, whereas the other three are completely closed. This last situation is shown in FIG. 6, where the valving member 14.1 is open and valving members 14.2, 14.3, 14.4 are in the closed position.

In the case where the two motors 45.13 and 45.24 are controlled to operate, two valving members 14 take up controlled open positions, which depend on the controls, whereas the other two valving members take up identical partially closed positions, because of the equal distribution of said incompressible hydraulic fluid in the circuit of chambers 38b and ducts 39. The overall opening of the two controlled valving members corresponds at most to complete opening of a single valving member, when the other two valving members are closed, each of said members then being able to free at most half of the corresponding nozzle neck, which configuration is shown in FIG. 2.

Figure 8:
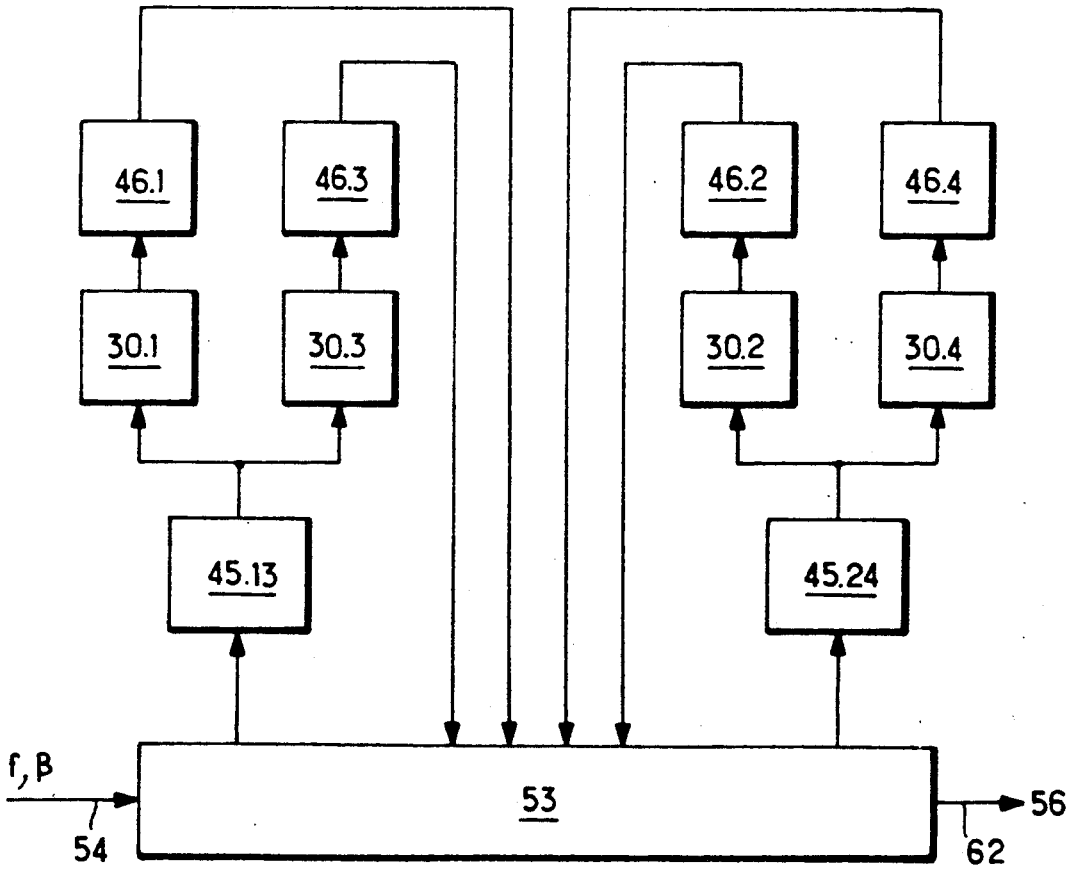
FIG. 8 shows the electric control diagram of the system of FIG. 6.

Since, as is known, the transverse thrust delivered by a gas jet leaving a nozzle 8 is a direct function of the opening of said nozzle, it can be seen that the transverse thrust delivered by the system of FIG. 8 about axis L—L of the missile is inscribed in a square 51 centered on said axis (see FIG. 7).

The apices of square 51 are situated on the axis of nozzles 8.1, 8.2, 8.3 and 8.4 and they correspond to maximum thrusts F1M, F2M, F3M and F4M which can be delivered by each of said nozzles, when the other three are completely closed, each of these maximum thrusts being equal to the thrust P which can be delivered by generator 9. In FIG. 7, the circle 52 of radius P has also been shown which corresponds to an homogeneous theoretical distribution of the thrust of generator 9 about axis L—L. It can be seen that to approximate this theoretical distribution and so further optimize the system of the invention, it is advantageous to increase the number of diametrically opposite nozzles, so that the square 51 is transformed into a polygon inscribed in said circle 52 as closely as possible.

As shown in FIG. 8, computing means 53 are provided on board missile 1 for controlling motors 45.13 and 45.24 so as to obtain, for force steering missile 1, any transverse thrust desired inscribed in square 51. For this, the computing means 53 receive (from a steering device not shown), at their input 54, the intensity and orientation of this desired thrust. Referring also to FIG. 7, it is assumed that this intensity is to be equal to f and that the orientation is given by the angle $\beta$ which said thrust forms with the axis of nozzle 8.1.

The transverse thrusts, due respectively to nozzles 8.1 to 8.4, are designated hereafter by F1, F2, F3 and F4.

As shown in FIG. 7, we may write:

$$f\cos\beta = F1 - F3 \quad (1)$$

and $$f\sin\beta = F4 - F2 \quad (2)$$

Furthermore, it is known that $$F1 + F2 + F3 + F4 = P \quad (3)$$

P being the thrust of generator 9.

Finally, because of the uniform distribution of the incompressible fluid in chambers 38b and ducts 39, we have $$F2 = F3 \text{ or } F1 = F4 \quad (4)$$

The computing means 53 have then available a system of four equations with four unknowns and they calculate F1, F2, F3 and F4 from f, $\beta$ and P. They then deliver orders to motors 45.13 and 45.24 which control respectively jacks 30.1 to 30.4. These in their turn, via the valving members 14.1 to 14.4, move the position measuring members 46.1 to 46.4 . The measurements thereof are representative of the opening of said valving members and so of the thrusts actually ordered F1 to F4, so that said measurements are addressed to the computing means 53 which may thus control the correct execution of their orders.

In the variant shown in FIG. 9, we find again the system of FIG. 6. A reserve of incompressible fluid 55 has further been provided for connection to duct 39 through a valve 56.

Reserve 55 has for example the form of a jack whose piston 57 is subjected to a pressure, for example by a part of the gases coming from generator g. In this case, an orifice 58 is provided for the input of said gases. Thus, piston 57 is pressed in the direction of valve 56 and pressurizes the incompressible fluid contained in jack 55.

The valve 56, besides its connection 5g to reserve 55 has another connection 60 to circuit 39 and an orifice 61 connected to exhaust. In FIG. 9, valve 56 isolates reserve 55 from circuit 3g. On the other hand, in FIG. 10a, valve 56 is in a position in which reserve 55 may introduce incompressible fluid into circuit 39. Finally, in FIG. 10b, the valve allows circuit 39 to be connected to exhaust 61.

Thus, reserve 55, associated with the valve 56, allows a constant volume of incompressible fluid to be provided in circuit 39, in a wide temperature range. In addition, in the case where generator 9 is of the type in which the combustion speed is sensitive to the pressure, this speed can be reduced, by connection to exhaust through valve 56, when said generator 9 being operated, we are then in a steering phase not requiring any transverse thrust for force steering.

Valve 56 is controlled by the output 62 of computer 53.

What is claimed is:

1. A system for steering a missile by means of gas jets, comprising a gas generator connectable to at least a pair of lateral nozzles via rotary valving means, movable under the action of drive means and controlling the passage of the gases through said nozzles: wherein with each nozzle is associated an individual rotary valving member;

each valving member is controlled in rotation by the piston of a jack, one chamber of which receives a part of the gas generated by said gas generator, the position of said piston being controlled by controlling the flowrate of said gas through said chamber;

the chambers of said jacks, opposite those receiving said gas flows, are connected together by a coupling circuit containing a pressurized incompressible fluid; and the volume of said pressurized incompressible fluid is chosen so that one of the valving members may be in the completely open position of the associated nozzle, whereas all the other valving members completely close the nozzles which correspond thereto.

2. The system as claimed in claim 1, wherein each nozzle has an oblong section, at least in the vicinity of its neck cooperating with a valving member.

3. The system as claimed in claim 2, wherein each valving member comprises a shaft fast with a projecting radial plate whose longitudinal end face cooperates with the neck of the corresponding nozzle.

4. The system as claimed in claim 3, wherein the lateral face of the radial plate, opposite the neck of the nozzle in the open position of said valving means, is concave and curved.

5. The system as claimed in claim 1, wherein said valving members are mounted in a rigid block integral with the structure of said missile.

6. The system as claimed in claim 5, in which said nozzles are formed in wings of said missile integral with the skin thereof, wherein the feet of said nozzles are fitted with a sliding fit in said rigid block.

7. The system as claimed in claim 1, wherein control of the gas flow through a jack is obtained by means of a linear motor moving a ball in a bell-mouth portion provided in the circuit of said gas flow.

8. The system as claimed in claim 1, comprising two pairs of lateral nozzles, with the two nozzles of a pair being diametrically opposite and the nozzles of a pair being disposed in a radial plane perpendicular to the radial plane containing the nozzles of the other pair, wherein, at most, a valving member of each pair of nozzles is controlled simultaneously with a valving member of the other pair of nozzles.

9. The system as claimed in claim 7, wherein the two valving members of a pair of nozzles are controlled by the same motor.

10. The system as claimed in claim 8, comprising computing means capable of solving the system of equations:

$$f \cos \beta = F1 - F3 \quad (1)$$

$$f \sin \beta = F4 - F2 \quad (2)$$

$$F1 + F2 + F3 + F4 = P \quad (3)$$

and $$F2 = F3 \text{ or } F1 = F4 \quad (4)$$

in which f is the intensity of a desired radial thrust, $\beta$ is the angle formed by said desired radial thrust with the radial thrust F1 from one of said nozzles, and F2, F3 and F4 are the radial thrusts from the other three nozzles.

11. The system as claimed in claim 1, comprising a pressurized incompressible fluid reserve able to be connected to said coupling circuit.

12. The system as claimed in claim 11, wherein said reserve is connected to said coupling circuit by a valve, capable of connecting said coupling circuit to exhaust.

* * * * *